United States Patent [19]

Kanai et al.

[11] Patent Number: 4,592,645

[45] Date of Patent: Jun. 3, 1986

[54] APPARATUS FOR CONTROLLING CONCENTRATION OF TONER IN DEVELOPER

[75] Inventors: Kenichi Kanai; Osamu Shimoe; Sadaji Tashiro, all of Kumagaya, Japan

[73] Assignee: Hitachi Metals, Ltd., Japan

[21] Appl. No.: 624,688

[22] PCT Filed: Nov. 28, 1983

[86] PCT No.: PCT/JP83/00422

§ 371 Date: Jun. 14, 1984

§ 102(e) Date: Jun. 14, 1984

[87] PCT Pub. No.: WO84/02202

PCT Pub. Date: Jun. 7, 1984

[30] Foreign Application Priority Data

Nov. 29, 1982 [JP] Japan ..... 57-207524
Nov. 29, 1982 [JP] Japan ..... 57-207525
May 30, 1983 [JP] Japan ..... 58-95282

[51] Int. Cl.[4] ..... G03G 15/08

[52] U.S. Cl. ..... 355/14 D; 118/688; 118/689; 355/3 DD

[58] Field of Search ..... 355/3 R, 3 DD, 14 D; 118/688, 689, 690

[56] References Cited

U.S. PATENT DOCUMENTS 3,698,926 10/1972 Furuichi ..... 355/3 DD X
4,147,127 4/1979 Terashima ..... 118/689
4,270,487 6/1981 Terashima et al. ..... 118/690
4,364,659 12/1982 Noda ..... 355/14 D

FOREIGN PATENT DOCUMENTS 50-099552 8/1975 Japan .
52-145072 12/1977 Japan .
57-111566 7/1982 Japan .

*Primary Examiner*—Fred L. Braun
*Attorney, Agent, or Firm*—Finnegan, Henderson, Farabow, Garrett & Dunner

[57] ABSTRACT

An apparatus for controlling the toner concentration of a developer includes a detector 14, 15 disposed at a predetermined position in a container containing a developer 5 having magnetic carrier and color toner, whereby the color toner is replenished into the container depending on the output of the detector until the toner concentration of the developer lies within a predetermined range. The detector has a plurality of magnetic circuits each having magnetic gaps, and the coupling coefficient of one of the magnetic circuits is set at a value equivalent to the coupling coefficient exhibited when the toner concentration of the developer lies within a predetermined range, while the coupling coefficient of another magnetic circuit is changeable in response to the actual toner concentration. The differential output of the two magnetic circuits is subjected to phase detection for comparing the coupling coefficient values of the two magnetic circuits and thereby detecting the toner concentration.

17 Claims, 8 Drawing Figures

D: SETTING

α: POSITIVE INTEGER

APPARATUS FOR CONTROLLING CONCENTRATION OF TONER IN DEVELOPER

TECHNICAL FIELD

This invention relates to an apparatus for controlling a concentration of toner in the two-component type developer.

BACKGROUND ART

Developers used for electrophotographic copying apparatus, facsimile apparatus, printers, etc. include a two-component type developer in the form of a mixture of a magnetic carrier and a color toner. When an electrostatic latent image is developed with such a developer, the color toner is consumed by attaching to the latent image. However, the magnetic carrier in the developer does not decrease, resulting in a decrease in the ratio of the color toner to the magnetic carrier in the developer (which ratio will be referred to hereinafter as toner concentration).

For attainment of good-quality development, it is necessary to maintain the toner concentration 11 of the developer within a predetermined range, and, for this purpose, there is a toner concentration control apparatus which detects the toner concentration of the developer to replenish the color toner in the developer.

As toner concentration detecting means in the above-described prior art apparatus, a planar electric coil has been disposed at a suitable position in the developer container surrounded by the stream of the developer, and, utilizing the fact that the coil inductance increases with the decrease of the toner concentration of the developer, the coil inductance value has been measured to detect the toner concentration.

However, the detection by measurement of the inductance has been defective in that temperature compensation is required to deal with variations of the inductance value due to changes in temperature and humidity, and, although the above problem is avoided by, for example, the additional provision of a temperature compensation circuit, sufficient temperature compensation is difficult when fluctuations between products are considered together with other problems including an increase in the number of component parts.

Another toner concentration detecting means is based on the fact that, in the developer contained in the developer container, the color toner only is consumed so that the quantity of the carrier remains constant without being consumed. Accordingly, a developer level detector is disposed at a predetermined position in the developer container to monitor the quantity of the developer, and the shortage is filled up by the color toner so as to control the toner concentration. This developer level detector may be implemented as a back-coupling oscillation circuit using an electric coil acting as a detecting member to detect the level of the developer on the basis of the oscillation level of this oscillation circuit.

However, the above proposal has been defective in that the successful condition of oscillation of the above-described back-coupling oscillation circuit is quite sensitive to the external environmental conditions including the temperature and humidity, and, because of such a problem, detection of the developer level may become utterly impossible, rendering sufficient compensation extremely difficult.

DISCLOSURE OF THE INVENTION

The present invention obviates the various defects as pointed out above and has for its object to provide an apparatus for controlling the toner concentration of a developer, which operates stably with high accuracy and without being affected by changes in external environmental conditions such as temperature and humidity.

The present apparatus is characterized by the provision of an apparatus for controlling the toner concentration of a developer comprising a detector disposed at a predetermined position in a container containing a developer including a magnetic carrier and a color toner so that the color toner can be replenished into the container depending on the output of the detector until the toner concentration of the developer lies within a predetermined range, wherein the detector is composed of a plurality of magnetic circuits having magnetic gaps, the coupling coefficient of one of the magnetic circuits being set at the value equivalent to the coupling coefficient exhibited when the toner concentration of the developer lies within the predetermined range, while the coupling coefficient of another of the magnetic circuits being changeable in proportion to the toner concentration, and the differential output of the two magnetic circuits is subjected to phase detection for comparing the coupling coefficient values of the two magnetic circuits thereby detecting the toner concentration.

BRIEF DESCRIPTION OF THE DRAWINGS

FIG. 1(*b*) is a vertical sectional, side elevation view of a developing apparatus using a second embodiment of the toner concentration control apparatus of the present invention.

FIG. 2(*b*) is a schematic diagram of a second embodiment of a toner concentration detector according to the present invention.

DESCRIPTION OF THE PREFERRED EMBODIMENTS

Embodiments of the present invention will now be described with reference to the drawings.

Figure 1A:
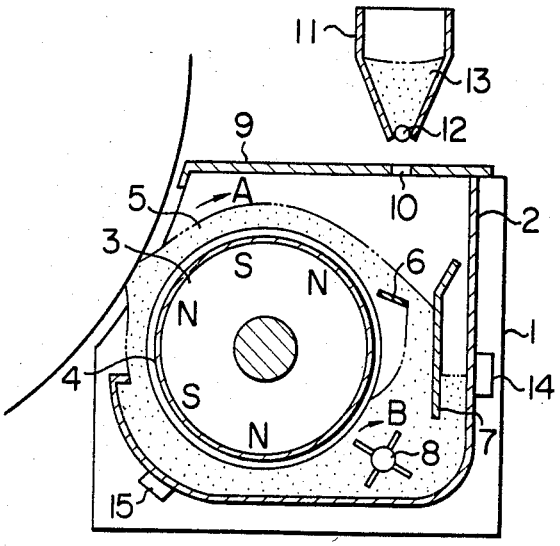
FIG. 1(*a*) is a vertical sectional, side elevation view of a developing apparatus using a first embodiment of the developer's toner concentration control apparatus according to the present invention.
Figure 1B:
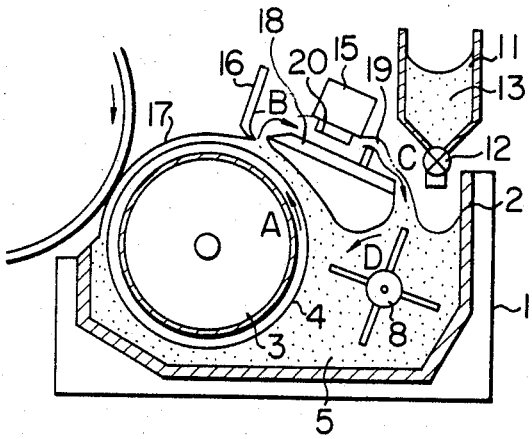

FIG. 1(*a*) is a vertical sectional, side elevation view of a first embodiment of a developer's toner concentration control apparatus according to the present invention.

Referring to FIG. 1(*a*), 1 designates a side plate, 2 designates a bottom plate made of a non-magnetic material, and the side plate 1 and bottom plate 2 constitute a developer container. 3 designates a magnet roll supported by the side plate 1, and 4 designates a sleeve of a non-magnetic material which is supported rotatably around the magnet roll 3 and is driven in the direction of the arrow A to rotate while holding a developer 5 attracted to its surface by the magnetic force of the magnet roll 3.

6 designates a separation plate for scraping off the developer from the surface of the sleeve 4, 7 designates a stabilizer plate for stabilizing the level of the developer in the container, 8 designates a stirrer rotating in the direction of the arrow B for making uniform the state of mixture of magnetic carrier and color toner in the developer, and 9 designates a cover having a toner replenishing opening 10.

11 designates a replenished toner hopper, 12 designates a toner replenishing valve, and 13 designates the color toner to be replenished. 14 and 15 designate detectors. When the toner concentration is to be detected on the basis of a change of the toner level variable in proportion to the content of the color toner in the developer, the detector 14 is mounted on the bottom plate 2 at a portion opposite to the stabilizer plate 7 provided for stabilizing the level of the developer in the container.

Also, when a change of the coupling coefficient value of a magnetic circuit varying in proportion to the toner concentration is to be detected, the detector 15 is fixed to the bottom plate 2 at a lower part of the container where the mixture ratio of the magnetic carrier and color toner in the developer is relatively stable without fluctuation.

Further, FIG. 1(*b*) is a vertical sectional view of a developing appratus using another embodiment of the developer's toner concentration control apparatus according to the present invention.

Referring to FIG. 1(*b*), 1 designates a side plate, 2 designates a bottom plate made of a non-magnetic material, and the side plate 1 and bottom plate 2 constitute a developer container. 3 designates a magnet roll supported by the side plate 1, and 4 designates a sleeve of a non-magnetic material which is supported rotatably around the magnet roll 3 and is driven in the direction of the arrow A to rotate while holding a developer 5 attracted to its surface by the magnetic force of the magnet roll 3. 16 designates a doctor blade mounted on the side plate 1 to be spaced apart by a suitable distance value from the sleeve 4 so that a magnetic brush 17 of the developer has an appropriate size. The developer scraped off as an excess from the sleeve 4 by the doctor blade 16 passes along the upper surface of a conveying plate 18 in the directions of the arrows B and C to flow down onto a stirrer 8 to be circulated. 15 designates a detector which is mounted directly above the conveying plate 18 in a relation spaced apart by a suitable distance therefrom so as to detect the toner concentration of the developer flowing along the upper surface of the conveying plate 18. 19 designates a stabilizer plate which stabilizes the stream of the developer flowing along a detection surface 20 of the detector 15 and along the upper surface of the conveying plate 18 thereby assisting in stable detection of the concentration. However, it is not necessarily required, and its shape has a degree of freedom. The stirrer 8 rotates in the direction of the arrow D and has the function of making uniform the state of mixture of a magnetic carrier and a color toner in the developer. 11 designates a replenished toner hopper, 12 designates a toner replenishing valve, and 13 designates the color toner to be replenished.

The developing apparatus used in the present embodiment is of the so-called up-feed type in which the doctor blade is disposed above the magnet roll. The best position for mounting the detector in this type of developing apparatus is above the conveying plate 18 for the following reasons.

The principal reason is that a portion of the developer forming the magnetic brush before the color toner is consumed in the developing step can be sampled so that the toner concentration can be stably detected.

The structure and function of the detectors 14 and 15 will now be described with reference to FIG. 2, FIG. 3 and FIG. 4.

Figure 2A:
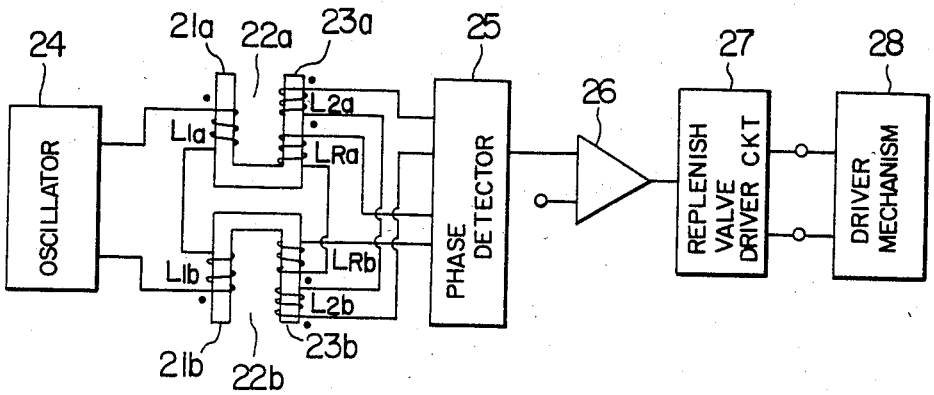
FIG. 2(*a*) is a schematic diagram of a toner concentration detector according to the present invention.
Figure 2B:
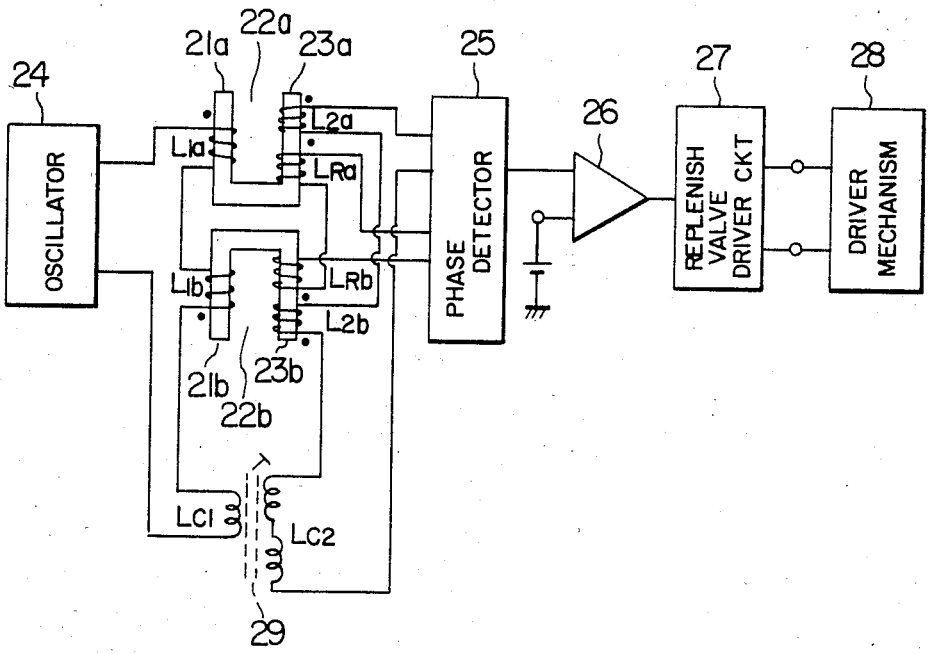
Figure 3:
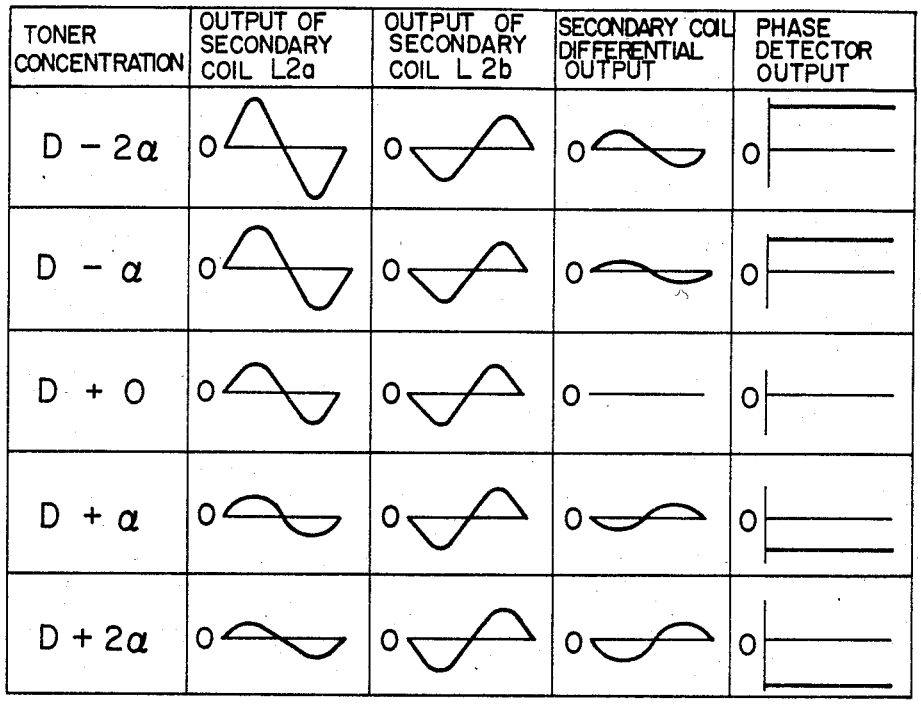
FIGS. 3 and 4 are diagrams illustrating the manner of operation of the detector according to the present invention.
Figure 4:
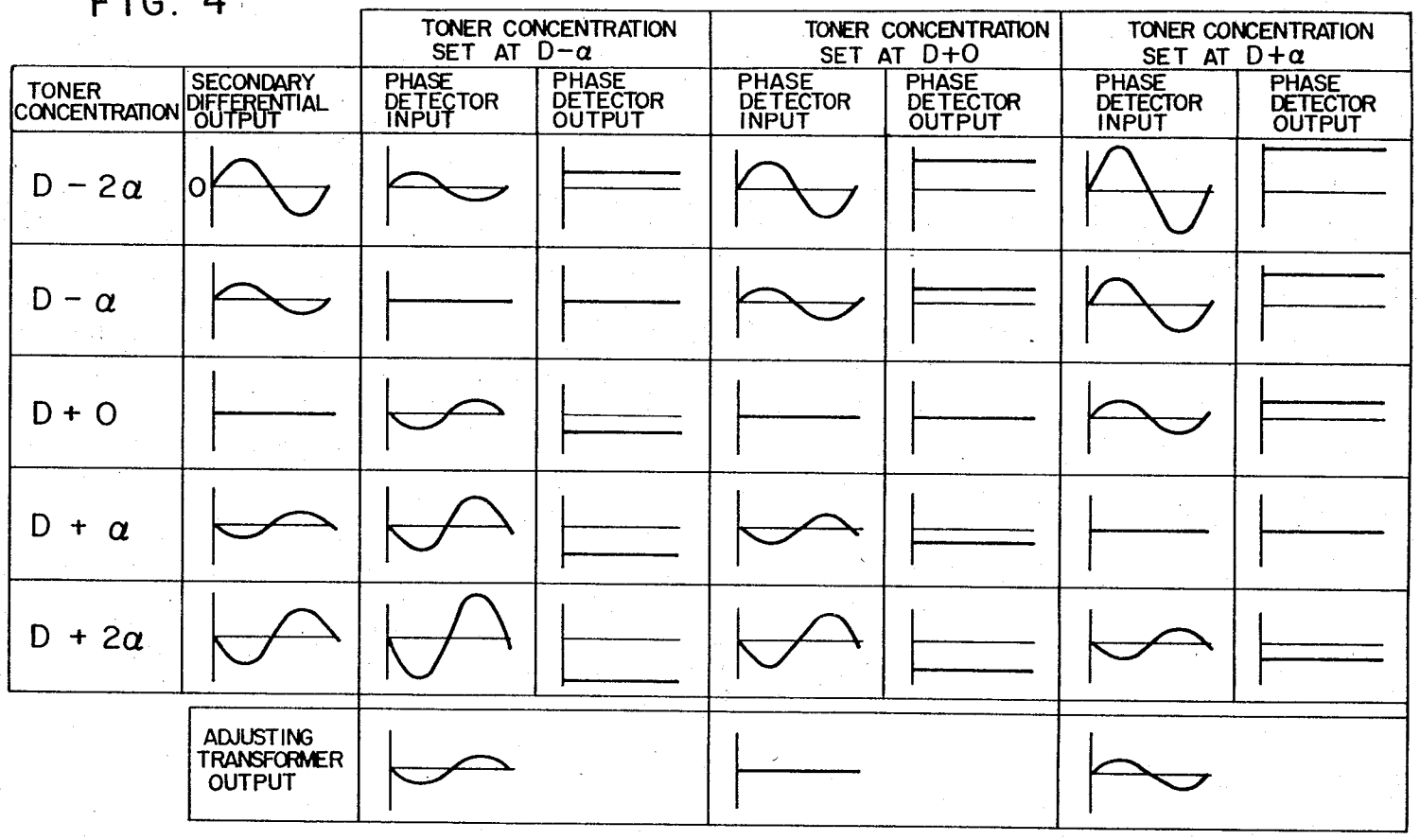

FIGS. 2, 3 and 4 are views illustrating schematically the structure of the detector in the toner concentration control apparatus of the present invention and views illustrating the manner of operation of the detector respectively.

In the detector 14 or 15 in the present invention, U-shaped magnetic cores 21*a* and 21*b* having magnetic gaps 22*a* and 22*a* constitute two transformers 23*a* and 23*b* as shown in FIG. 2(*a*). The transformers 23*a* and 23*b* have primary coils $L_{1a}$, $L_{1b}$ and secondary coils $L_{2a}$, $L_{2b}$ wound therearound respectively. On the secondary side, reference signal detecting coils $L_{Ra}$ and $L_{Rb}$ are wound. The primary coils $L_{1a}$ and $L_{1b}$, which are connected in series so that the flowing directions of magnetic flux are opposite to each other in the two magnetic circuits, are connected to output terminals of an oscillator 24. The secondary coils $L_{2a}$ and $L_{2b}$, which are connected in series in opposite polarities so as to obtain their differential output, and the reference signal detecting coils $L_{Ra}$ and $L_{Rb}$, which are connected in series in the same polarity, are connected to signal input terminals and reference signal input terminals respectively of a phase detector 25. In the magnetic circuits, from the aspect of type, the primary coils $L_{1a}$, $L_{1b}$ and the secondary coils $L_{2a}$, $L_{2b}$ constitute a transformer of a differential type, while the primary coils $L_{1a}$, $L_{1b}$ and the reference signal detecting coils $L_{Ra}$, $L_{Rb}$ constitute a transformer of a conventional type. The phase detector 25 is connected at its output to a potential comparator 26, and the output of the latter is connected to a replenishing valve driver circuit 27.

Further, in the detector 14 or 15 fixed to the bottom plate 2 of the container in the present invention, the developer 5 is located in the magnetic gap 22*a* of the U-shaped core 21*a*, while an adjusting screw (not shown) for adjusting the coupling coefficient of the transformer 23*b* is disposed in the magnetic gap 22*b* of the U-shaped core 21*b* so as to adjust the coupling coefficient of the transformer to be equivalent to the value exhibited when the toner concentration lies within a predetermined range.

The operation of the detector having the above-described structure, for example, the detector 15 shown in FIG. 1(*a*), will now be described. With the rotation of the sleeve 4 of the developing apparatus in the direction of the arrow A, a magnetic brush of the developer 5 is formed on its surface to develop an electrostatic latent image. After development, the magnetic brush is separated by the separation plate 6 from the surface of the sleeve 4 to be scraped away toward the bottom of the container. The developer 5 thus scraped away is uniformly stirred by the stirrer 8 and is circulated to form the magnetic brush again. The stabilizer plate 7 stabilizes the level of the developer 5 in the container to be detected by the detector 14.

When the oscillation ouput from the oscillator 24 is applied to the primary coils $L_{1a}$ and $L_{1b}$, the output signals corresponding to the coupling coefficients of the respective magnetic circuits are induced in the secondary coils $L_{2a}$ and $L_{2b}$. When the toner concentration in the developer lies within a predetermined range, the coupling coefficient of the magnetic circuit of the transformer 23*a* is equivalent to the coupling coefficient of the magnetic circuit of the transformer 23*b* previously set at this predetermined value, and the outputs of the two secondary coils $L_{2a}$ and $L_{2b}$ of opposite phase cancel each other to provide zero differential output.

When, with the development of latent images, the color toner in the developer decreases to lower the toner concentration, the density of the magnetic carrier in the developer increases to increase the apparent permeability of the developer, and the coupling coefficient of the magnetic circuit of the transformer 23*a* becomes larger than the coupling coefficient of the magnetic circuit of the transformer 23*b*, resulting in appearance of a differential output. Accordingly, the phase detector 25 detects that differential output and generates a phase detector output corresponding to the specific phase.

This output signal is compared in the potential comparator 26 with a reference voltage corresponding to the pre-set toner concentration, and its output actuates the replenishing valve driver circuit 27 to energize the toner replenishing valve 12 thereby replenishing the color toner 13.

The output of the secondary coils $L_{2a}$ and $L_{2b}$ corresponding to each of concentration difference $-2\alpha$, $-\alpha$, $\alpha=0$, $+\alpha$ and $+2\alpha$ ($\alpha$: a positive integer) indicative of the toner concentration of the developer relative to the above-described setting D of the toner concentration, the corresponding differential output and the phase detector output are as shown in FIG. 3.

Although the above description has referred to the provision of an adjusting screw in the magnetic gap of the magnetic core of the detector for adjusting the coupling coefficient of the transformer, an adjusting transformer for fine adjustment may be additionally provided in the present invention so as to attain more delicate adjustment. That is, as shown in FIG. 2(*b*), the primary coils $L_{1a}$ and $L_{1b}$ are connected to the output terminals of the oscillator 24 through a primary coil $L_{C1}$ of an adjusting transformer 29, and the secondary coils $L_{2a}$ and $L_{2b}$ connected in series in opposite polarities to obtain their differential output are connected to the signal input terminals of the phase detector 25 through a secondary coil $L_{C2}$ of the adjusting transformer 29. The reference signal detecting coils $L_{Ra}$ and $L_{Rb}$ connected in series in the same polarity are connected to the signal input terminals and reference signal input terminals of the phase detector 25 respectively. In the magnetic circuits, from the aspect of type, the primary coils $L_{1a}$, $L_{1b}$ and the secondary coils $L_{2a}$, $L_{2b}$ constitute a transformer of differential type, while the primary coils $L_{1a}$, $L_{1b}$ and the reference signal detecting coils $L_{Ra}$ and $L_{Rb}$ constitute a transformer of conventional type. $L_{C1}$ and $L_{C2}$ constitute the adjusting transformer 29. Although the transformer 29 is shown to be of differential type in this example, it may be a transformer of conventional type.

The phase detector 25 is connected to apply its output to the potential comparator 26, and the output of the latter is connected to the replenishing valve driver circuit 27. The output of this replenishing valve driver circuit 27 is applied to a driver mechanism 28 for driving the valve 12.

In the case of the detector described with reference to FIG. 2(*a*), the toner concentration is set by rotating the adjusting screw of a magnetic material mounted in the vicinity of the magnetic gap of the transformer 23*b* thereby changing the distance between it and the gap to provide a suitable coupling coefficient to the transformer 23*b*. However, the coupling coefficient changes greatly relative to the angular rotation of the screw, resulting in difficulty of accurate adjustment. The adjusting transformer 29 in the structure shown in FIG. 2(*b*) has the function of compensating for this defect, and, after the coupling coefficient value of the transformer 23*b* is roughly adjusted by the adjusting screw to a value close to the optimum value, the transformer 29 is manipulated for the accurate setting and fine adjustment.

A practical example using the adjusting transformer will now be described. As described already, both the primary side and the secondary side are connected in series with $L_{1a}$, $L_{1b}$ and $L_{2a}$, $L_{2b}$, and the whole circuit arrangement is as shown in FIG. 2(*b*). By the mechanism adjusting the secondary-side output, a suitable AC output $V_{adj}$ is generated from the secondary side. Since the transformer is constructed to be of the differential type in this example, we can get not only the same phase AC output but also the opposite one to the reference phase. An AC signal having the adjusting transformer output $V_{adj}$ superposed on the differential output from $L_a$ and $L_b$ is applied to the phase detector.

Accordingly, the toner concentration providing the same phase detector output is changed by the proportion corresponding to the superposition of $V_{adj}$. In FIG. 3, in order to change the toner concentration setting from D to $D+\alpha$ while remaining fixed the adjusting screw on the $L_b$ side when the reference voltage of the voltage comparator is 0 V, the adjustment may be such that an AC voltage which is the same in amplitude but opposite in phase to the differential output from the secondary coils at the illustrated concentration $D+\alpha$ is generated from the secondary side of the adjusting transformer.

FIG. 4 schematically illustrates the secondary coil differential output, adjusting transformer output and phase detector input and output when the toner concentration setting is changed to $D+\alpha$, $D+0$ and $D-\alpha$ by the adjusting transformer while maintaining the adjusting screw added to the transformer 23*b* in the states of FIG. 3.

Next, another embodiment will be described with reference to FIG. 5.

Figure 5A:
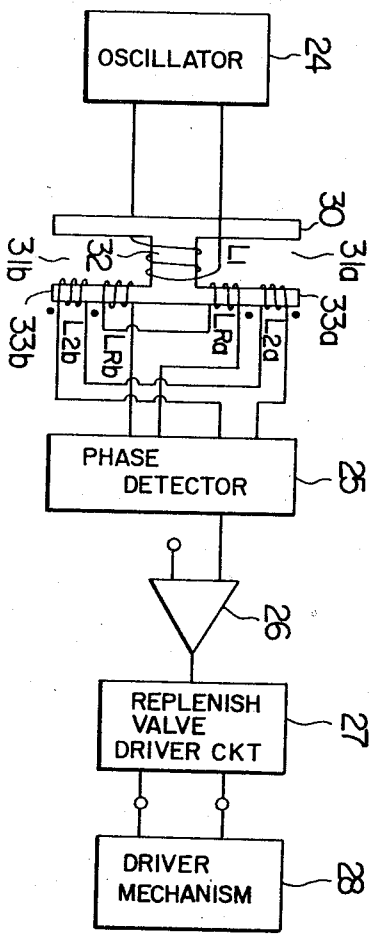
FIGS. 5(*a*) and (*b*) are each a schematic diagram of third and fourth embodiments, respectively, of a toner concentration detector used in the developer's toner concentration control apparatus according to the present invention.
Figure 5B:
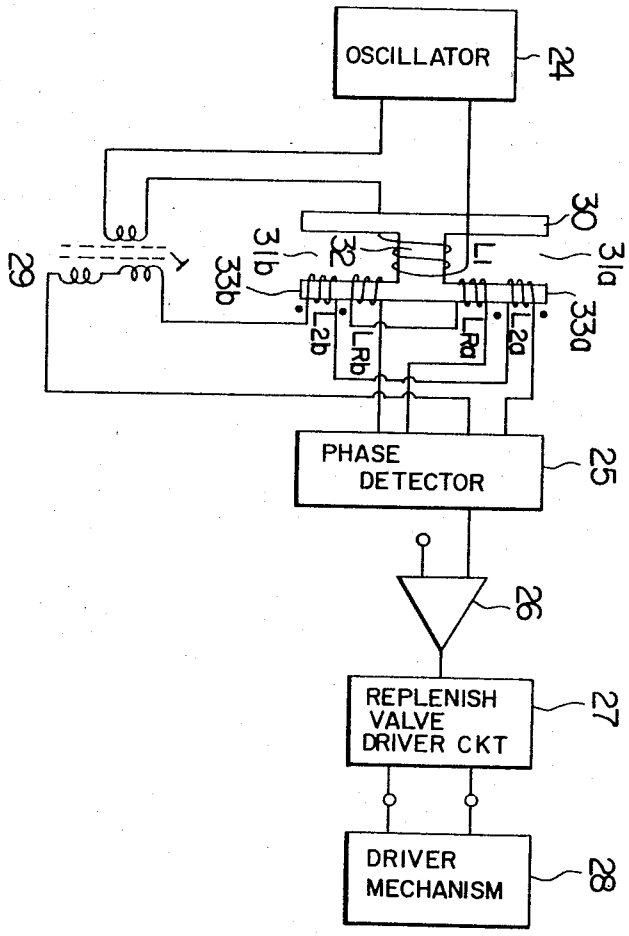

FIG. 5 is a view schematically illustrating third and fourth embodiments of the structure of toner concentration detectors for the developer's toner concentration control apparatus according to the present invention.

The present embodiment of the developer's toner concentration control apparatus is structurally different from the aforementioned embodiment of the toner concentration control apparatus in its toner concentration detectors only, and the remaining structures are substantially similar.

In FIG. 5, the same reference numerals are used to designate equivalent parts appearing in FIG. 2. 30 designates an H-shaped magnetic core, and a pair of magnetic circuits having magnetic gaps 31*a* and 31*b* include a partly common magnetic path portion 32. The primary coil $L_1$ is wound around the partly common magnetic path portion 32 and is connected to the output terminals of the oscillator 24. The secondary coils $L_{2a}$, $L_{2b}$ and the reference signal detecting coils $L_{Ra}$, $L_{Rb}$ are wound symmetrically around arms 33*a* and 33*b* respectively of the H-shaped core 30. The secondary coils $L_{2a}$ and $L_{2b}$ connected in series in opposite polarities so as to obtain their differential output and the reference signal detecting coils $L_{Ra}$ and $L_{Rb}$ connected in series in the same polarity, are connected to the signal input terminals and reference signal input terminals of the phase detector 25, as in the case of FIG. 2 showing the preceding embodiment. The phase detector 25 is connected to apply its output to the potential comparator 26, and the output of the latter is connected to the replenishing valve driver circuit 25.

In the present invention, various characteristics such as the temperature characteristics of a plurality of magnetic circuits providing the detector part can best be compensated and matched when the individual magnetic circuits are formed of the same material and shaped and sized to be identical or symmetrical, i.e., point-symmetrical, line-symmetrical or plane-symmetrical. Therefore, an arrangement as shown in FIG. 5 is very effective for stable detection of the toner concentration.

Since the structure of the toner concentration detector in the present embodiment is as described above and its function and effect are similar to the function and effect of the toner concentration detector in the embodiment shown in FIG. 2, its explanation is omitted.

INDUSTRIAL APPLICABILITY

As described in the foregoing, in the developer's toner concentration control apparatus according to the present invention, a plurality of magnetic circuits having magnetic gaps are provided with a detector, and output signals of two magnetic circuits are compared to detect the toner consentration for replenishing a color toner, so that the detector is not substantially adversely affected by changes of the external environmental conditions including the temperature and humidity.

Although a reference signal of a phase detector is derived as the output of the transformers in the detector in the aforementioned embodiments, the reference signal may be derived from the oscillator part, and, although an independent oscillator is used as the oscillator, an LC oscillator using its primary coil as an inductor may be employed.

Further, it was ascertained that the primary coils $L_{1a}$ and $L_{1b}$ may be connected in parallel, and the function is similarly exhibited even when the directions of magnetic flux may be the same.

In addition, since fluctuation or a delay appears in the phase detector output related to the detected toner concentration because of the fact that the developer is actually a powdery mixture and flows on the detecting surface and that there is a time delay until the developer is uniformly mixed after the toner replenishing valve 12 is opened to replenish the color toner, it is practically useful for the stabilization of the function of the entire toner concentration control apparatus to insert an integrator or a smoothing circuit between the phase detector 25 and the potential comparator 26 thereby averaging the phase detector output relative to time, to operate the potential comparator with a suitable hysteresis, and to operate the replenishing valve driver circuit 27 with appropriate quantized drive or to provide a dead time, etc.

Further, although the phase detector 25 is used in the detector 14 or 15 in the embodiments, a phase comparator may also be used to decide, with high accuracy, an excess or a shortage of the toner concentration.

As described above, it is summarized that the present invention can provide an apparatus for controlling, stably and with high accuracy, the toner concentration of a developer, which is not adversely affected by changes of the external environmental conditions including the temperature and moisture, and can be said to be an invention which is excellent in its practical effect.

We claim:

1. A detector for controlling toner concentration of a developer including a magnetic carrier and a color toner, comprising:

a plurality of magnetic circuits each having magnetic gaps, the coupling coefficient of one of said magnetic circuits being set at a predetermined value equivalent to the coupling coefficient exhibited when the toner concentration lies within a predetermined range, and the coupling coefficient of the other of said magnetic circuits varying in proportion to the toner concentration;

coil members wound about each of said magnetic circuits for yielding a differential output from said magnetic circuits;

source means coupled to said magnetic circuits for providing a reference A.C. signal; and phase detector means for comparing the phases of the differential output and the reference A.C. signal, and for yielding a D.C. voltage based on the phase comparison.

2. A detector according to claim 1, wherein said plurality of magnetic circuits include magnetic cores formed of like material and having like shapes and sizes.

3. A detector according to claim 1, wherein said plurality of magnetic circuits include cores having at least one of point symmetry, line symmetry and plane symmetry, and said source means is coupled to said magnetic circuits via a primary coil wound around a common magnetic path portion of said magnetic circuits.

4. A detector according to claim 1, further comprising comparator means for comparing the D.C. voltage with a reference voltage.

5. A detector for controlling toner concentration of a developer including a magnetic carrier and a color toner, comprising:

a plurality of magnetic circuits each having magnetic gaps, the coupling coefficient of one of said magnetic circuits being set at a predetermined value equivalent to the coupling coefficient exhibited when the toner concentration lies within a predetermined range, and the coupling coefficient of other of said magnetic circuits varying in proportion to the toner concentration;

coil members wound about each of said magnetic circuits for yielding a differential output from said magnetic circuits;

source means coupled to said magnetic circuits for providing a reference A.C. signal;

transformer means having an adjustable secondary output for selectively adjusting the differential output of said magnetic circuits; and phase detector means for comparing the phases of the differential output and the reference A.C. signal and for yielding a D.C. voltage based on the phase comparison.

6. A detector according to claim 5, wherein said transformer means comprises a transformer of a differential type.

7. A detector according to claim 5, wherein said plurality of magnetic circuits include magnetic cores formed of like material and having like shapes and sizes.

8. A detector according to claim 5, wherein said plurality of magnetic circuits include magnetic cores having at least one of point symmetry, line symmetry and plane symmetry, and said source means are coupled to said magnetic circuits via a primary coil wound around a common magnetic path portion of said magnetic circuits.

9. A detector according to claim 5, further comprising comparator means for comparing the D.C. voltage with a reference voltage.

10. An apparatus for controlling toner concentration of a developer including a magnetic carrier and a color toner, comprising:

a container containing said developer;

means for dispensing the color toner into said container; and detector means disposed at a predetermined position in said container and coupled to said dispensing means for allowing the color toner to be replenished into said container until an output from the detector indicates the toner concentration lies within a predetermined range, the detector means including:

a plurality of magnetic circuits each having magnetic gaps, the coupling coefficient of one of said magnetic circuits being set at a predetermined value equivalent to the coupling coefficient exhibited when the toner concentration lies within a predetermined range, and the coupling coefficient of the other of said magnetic circuits varying in proportion to the toner concentration;

coil members wound about each of said magnetic circuits for yielding a differential output from said magnetic circuits;

source means coupled to said magnetic circuits for providing a reference A.C. signal; and phase detector means for comparing the phases of the differential output and the reference A.C. signal and for yielding a D.C. voltage based on the phase comparison.

11. A toner concentration control apparatus according to claim 10, wherein said detector means further includes transformer means having an adjustable secondary for selectively adjusting the differential output of said magnetic circuits.

12. A toner concentration control apparatus according to claim 11, wherein said container has a bottom plate and a stabilizer plate, and said predetermined position is on the bottom plate opposite to the stabilizer plate.

13. A toner concentration control apparatus according to claim 11, wherein said container has a bottom plate and said predetermined position is on a portion of the bottom plate in a lower portion of said container.

14. A toner concentration control apparatus according to claim 11, wherein said container has a conveying plate and said predetermined position is directly above said conveying plate.

15. A toner concentration control apparatus according to claim 10, wherein said container has a bottom plate and a stabilizer plate, and said predetermined position is on the bottom plate opposite to the stabilizer plate.

16. A toner concentration control apparatus according to claim 10, wherein said container has a bottom plate and said predetermined position is on a portion of the bottom plate in a lower part of said container.

17. A toner concentration control apparatus according to claim 10, wherein said container has a conveying plate and said predetermined position is directly above said conveying plate.

* * * * *